US007095868B2

(12) United States Patent
Geddes

(10) Patent No.: US 7,095,868 B2
(45) Date of Patent: Aug. 22, 2006

(54) PHASE PLUG WITH OPTIMUM APERTURE SHAPES

(76) Inventor: Earl Geddes, 43516 Scenic La., Northville, MI (US) 48167

( * ) Notice: Subject to any disclaimer, the term of this patent is extended or adjusted under 35 U.S.C. 154(b) by 179 days.

(21) Appl. No.: 10/361,327

(22) Filed: Feb. 10, 2003

(65) Prior Publication Data

US 2004/0156519 A1 Aug. 12, 2004

(51) Int. Cl.
*H04R 25/00* (2006.01)

(52) U.S. Cl. ..... 381/343; 381/337; 381/339; 381/340; 181/177; 181/185; 181/187; 181/189; 181/192

(58) Field of Classification Search ..... 381/340–343, 381/182, 186, 335, 351, 386, 337–339, 428; 181/152, 144, 148, 159, 160, 185, 192–195, 181/186, 177, 184, 187, 188, 191, 199
See application file for complete search history.

(56) References Cited

U.S. PATENT DOCUMENTS 2,037,187 A 4/1936 Weate
3,852,529 A * 12/1974 Schafft ..... 381/75
4,050,541 A * 9/1977 Henricksen ..... 181/159
4,091,891 A * 5/1978 Hino et al. ..... 181/185
4,718,517 A * 1/1988 Carlson ..... 181/159
4,975,965 A * 12/1990 Adamson ..... 381/343
5,117,462 A 5/1992 Bie
6,026,928 A * 2/2000 Maharaj ..... 181/152
6,064,745 A * 5/2000 Avera ..... 381/343
6,628,796 B1 * 9/2003 Adamson ..... 381/342
6,744,899 B1 * 6/2004 Grunberg ..... 381/343
2002/0021815 A1 * 2/2002 Button et al. ..... 381/343

OTHER PUBLICATIONS

Earl Geddes, Audio Transducers (Book) Jul. 2002, pp. 126-164, Gedlee Publishing www.Gedlee.com.

* cited by examiner

*Primary Examiner*—Suhan Ni
*Assistant Examiner*—Dionne Harvey

(57) ABSTRACT

A phase plug for optimally matching a drive-unit's diaphragm to the throat of a waveguide is disclosed. Specific embodiments of a circular diaphragm matched to an elliptical waveguide and a circular diaphragm to a rectangular waveguide are disclosed.

6 Claims, 15 Drawing Sheets

Section 0-A

Section 0-C

Section C.1

Section C.2

Section C.3

Section 0-D

Section D.1

Section D.2

Section D.3

Section 0-E

Section E.1

PHASE PLUG WITH OPTIMUM APERTURE SHAPES

BACKGROUND

1. Field of the Invention

The present invention relates to the design of the phase plug in an electro-acoustic transducer composed of the phase plug and drive-unit, and waveguide assemblies.

2. Description of Prior Art

In high performance audio playback systems it is common practice to use wave guiding devices coupled to an electro-acoustic transducer drive-unit (that portion of an electro-acoustic transducer that does the direct electrical to acoustical transduction) that act to both amplify and direct the sound energy created therein. These devices go by many names, the most common being "horns" and "waveguides", waveguides—a newer term—implies that more importance is given to the directivity controlling aspects of these devices than the loading ones. I will use the term waveguide consistent with its new meaning, but it is also my intention to mean any and all devices performing such tasks regardless of name.

The "shape" of the wavefront presented to the input aperture of the waveguide (the throat) has a great influence on how the device radiates sound from the open end (the mouth), particularly at the higher frequencies. Shape in the context of this application means the bounding area of a plane perpendicular to the sound channel propagation, it is a two dimensional surface, but it can also refer to the surface velocity distribution (complex number map) in that same surface. In order to control the formation of the throat wavefront it is common practice to place a plug containing multiple phase equalizing channels between the drive-unit diaphragm and the throat of the waveguide. This plug is usually designed so as to direct the sound waves emitted from the drive-unit diaphragm into the waveguide throat aperture in a prescribed shape. This plug is also know by various names, the most common being "phase plug", "phasing plug" or "equalizer".

The art of phase plug design is well advanced. The first significant disclosure of the function of a phase plug is provided by Wente, U.S. Pat. No. 2,037,187 (1936). Wente notes that the goal is to provide an essentially planar wavefront at the horn throat and he achieves this task by directing the sound through phase equalizing channels of essentially equal length, thereby ensuring that the contributions all add in phase.

In Henricksen, U.S. Pat. No. 4,050,541 (1977), discloses an alternate type of phase plug wherein the phase equalizing channels are radial, as opposed to more common circumferential.

Carlson, U.S. Pat. No. 4,718,517 (1988), discloses a phase plug which has a rectangular exit aperture at the throat end to better match the waveguide throat, but at the input end at the drive-unit diaphragm, the phase equalizing channels are also rectangular which is not ideal. Carlson recognizes the need for a phase plug when transitioning from a circular source to a non-circular one but does so utilizing only a single channel of non-varying cross section (obviously easy to fabricate) or he uses two phase equalizing channels which are still not ideally matched to the circular diaphragm. In the later case the phase equalizing channels vary only in size—not shape—as they progress, and they are not concentric. In terms of performance (but not necessarily so in terms of manufacturing case) Carlson's design is not optimal. The phase plug's phase equalizing channels entrance shape is not well matched to the diaphragm resulting in unequal phase propagation summation effects at the waveguide throat which will result in distortions of the sound.

Bie, U.S. Pat. No. 5,117,462 (1992), utilizes the voice coil motion as part of the radiating surface of the drive-unit and adds a sound channel to said radiating region. He also shows a phase plug with non-concentric round phase equalizing channels.

Finally, Keith, U.S. Pat. No. 6,064,745 (2000), discloses an improved radial type of phase plug which is easier to manufacture than previous designs. The input shapes are not circles, they are triangular.

Each of these inventions claims a distinct improvement over the others in regard to performance, manufacturability and/or some other comparable; however, none of them discloses a phase plug design which optimally matches a drive-unit's diaphragm shape to a waveguide throat of different shape (as can be required by waveguide theory). By using phase equalizing channels which transition gradually from circular at the diaphragm to non-circular at the exit an improved phase plug design can be implemented.

Adamson acknowledged in U.S. Pat. No. 4,975,965 (column 5, lines 56–64) that his phase plug "has been found to be particularly useful when applied to acoustic waveguide speakers of the variety developed by Dr. E. R. Geddes . . . "—the current inventor. The waveguide referred to by Adamson was based on the oblate spheroidal coordinate system. In Chapter 6 of my book *Audio Transducers*, (GedLee Publishing, July, 2002), I discuss the fact that there are several different coordinate systems which yield useful waveguides (see table 6.1 in the text) and that each one has a different set of radiation characteristics. As discussed in this text, these different waveguides require different wavefront shapes at the throat ("source aperture" and "curvature" in the table of my text) for optimum performance.

In order to optimally match a drive-unit to a waveguide, it is desirable to have a phase plug that adapts the motion of a generally circular diaphragm to a desired aperture shape in a manner which brings the velocities of various portions of the circular diaphragm to the exit aperture in a prescribed, but generally in-phase, manner. There are situations where the velocity distribution (the velocity shape) in the phase plug's exit aperture (the waveguides throat) may want to be non-uniform.

An preferred embodiment of the invention disclosed in this specification occurs when connecting a circular drive-unit to a waveguide that requires an elliptical throat aperture. The phase plug in this case should have a shape at the input end that is circular or annular such as concentric annular rings spaced so that each ring has the smallest path length to those diaphragm points which excite it, i.e. the shapes conform to the circular source. At the exit aperture the shapes are concentric elliptical rings, typically of equal area and arranged so that there combined shapes equal the shape required by the waveguides throat.

In none of the prior art is it recognized that the optimum phase plug would have the requirements highlighted above. It was generally assumed that the phase plug's exit aperture (the throat of the waveguide) should be circular, or one with an equally simple shape to fabricate so long as the shapes of the sound channels at the input and output ends remain constant. In most cases the waveguide throat is adapted to match the phase plug's exit aperture—not the other way around. The prior art generally conforms to a design approach where ease of manufacture is emphasized, steering away from more complicated sound channel shapes because of manufacturing concerns. Today, injection molding complex phase plugs in plastic is a relatively easy manufacturing process and so complex shapes need no be avoided and more effective phase plugs can be readily fabricated.

OBJECTS AND ADVANTAGES

The primary object of this invention is a phase plug design which allows the drive-unit diagram shape to be optimally matched to a waveguide throat. The advantage of this optimum matching is that it creates a drive-unit/waveguide combination which has improved performance over one in which either; the waveguide shape is compromised to match the exit aperture from the drive-unit phase plug (usually circular in a "compression driver"—the usual name for a drive-unit phase plug combination), or; the phase plug input shape is not optimally matched to the diaphragms shape.

DRAWING FIGURES

REFERENCE NUMERALS IN DRAWINGS

| | |
|---|---|
| 10 | generic drive-unit |
| 20 | phase plug |
| 22 | phase plug diaphragm end |
| 24 | phase plug exit aperture |
| 25 | sound equalizing channels |
| 30 | waveguide |
| 40 | attachment bolt |

SUMMARY

In accordance with the present invention, a phase plug is disclosed which has the ability to optimally match a given drive-unit diaphragm shape to a chosen waveguide by utilizing sound equalizing channels that transition from the optimum shape at the diaphragm to the optimum shape at the waveguide.

DESCRIPTION FIGS. 1 TO 5

There can be many ways to assemble a drive-unit, phase plug and waveguide, but only a typical structure will be shown here for brevity.

Figure 1:
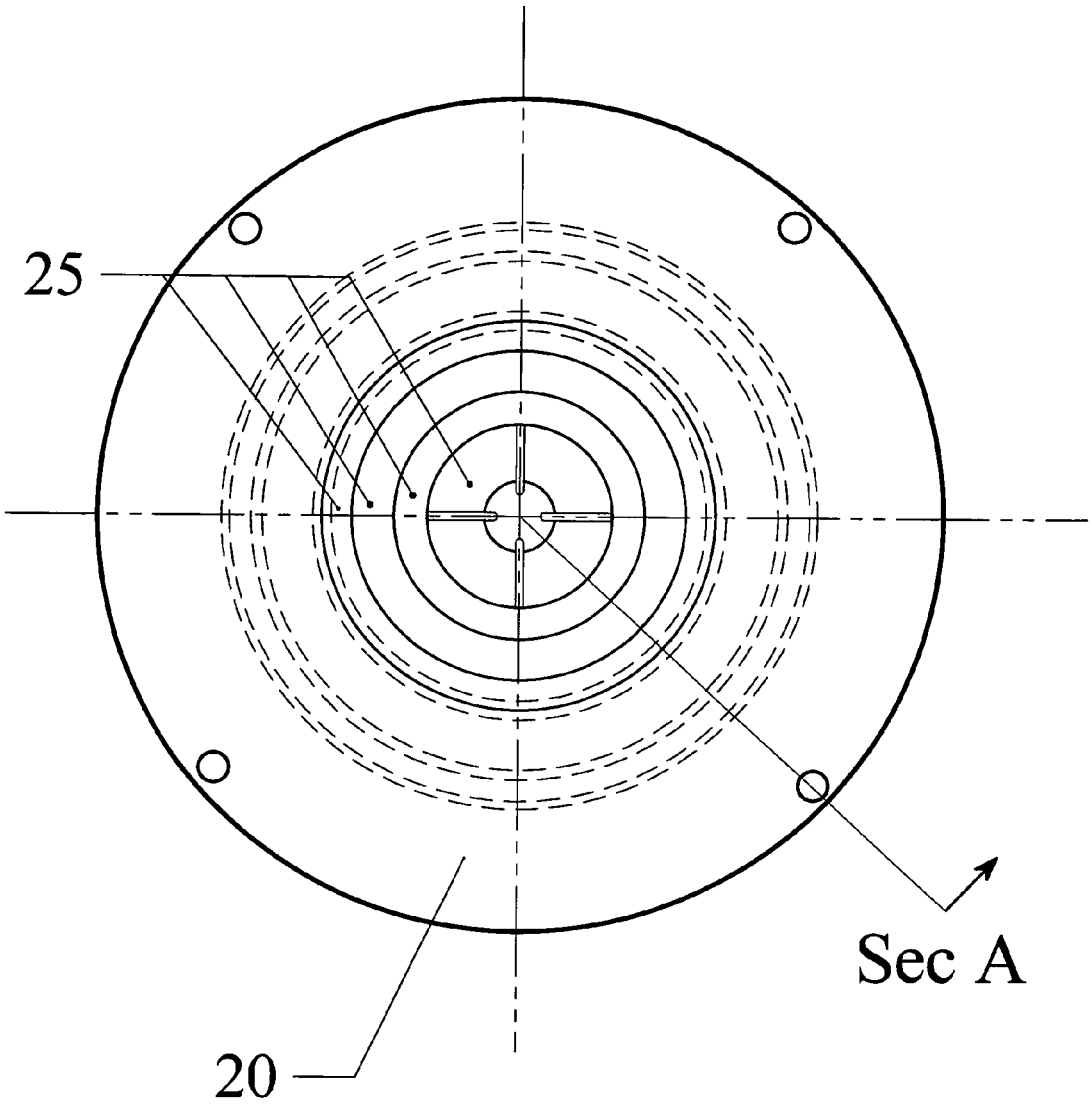
(Prior Art) Fig. 1
FIG. 1 shows a top view of a phase plug horn combination of conventional design.
Figure 2:
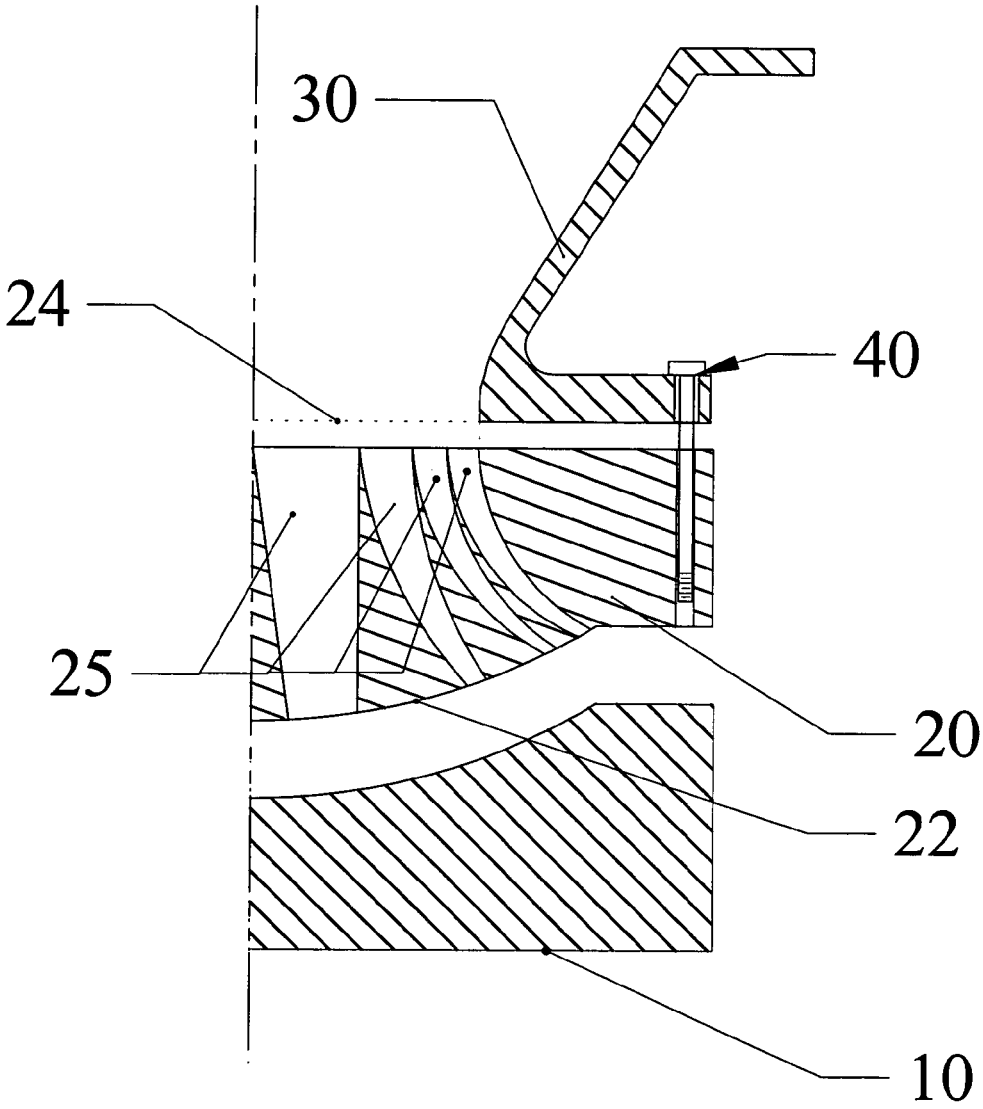
FIG. 2 shows an exploded view of the axi-symmetric cross section 0–A of a phase plug and the attachment of the phase plug to the waveguide.
Figure 3A:
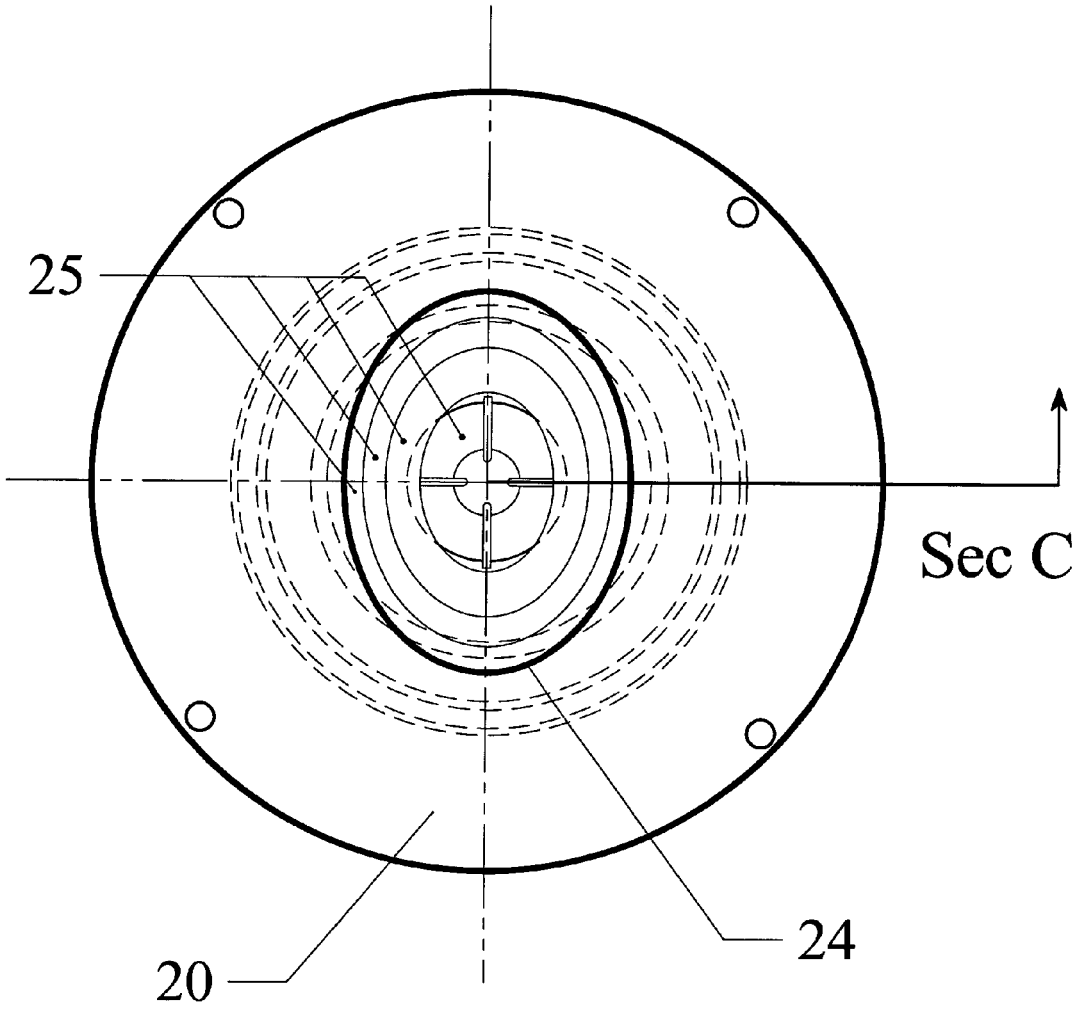
FIG. 3 shows a top view of a phase plug which has an elliptical exit aperture for use on a waveguide designed around the ellipsoidal coordinate system.
Figure 3B:
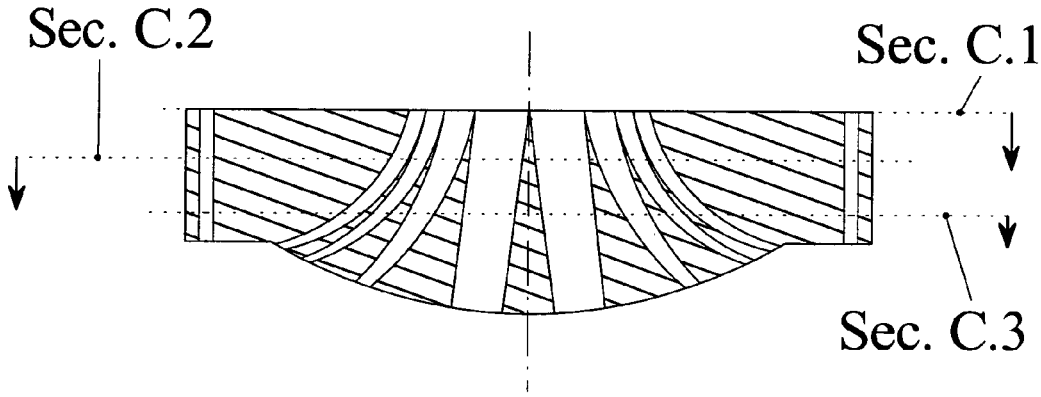
Figure 3C:
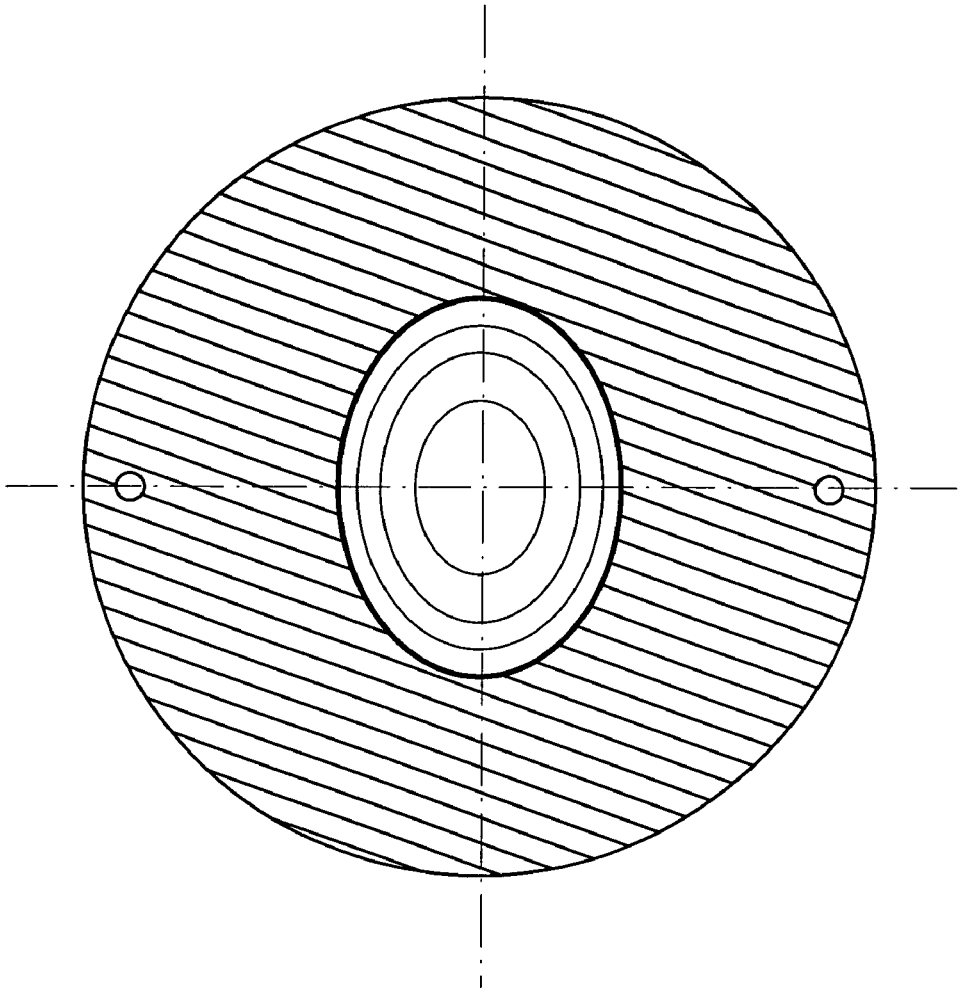
Figure 3D:
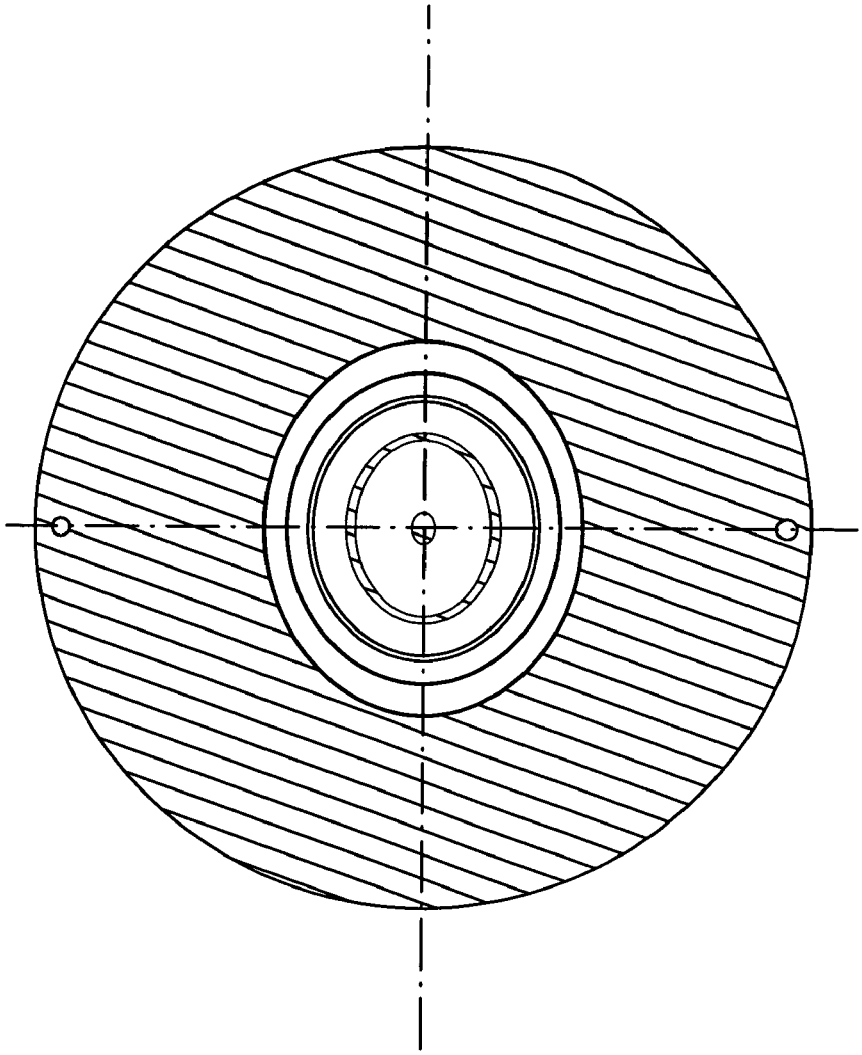
Figure 3E:
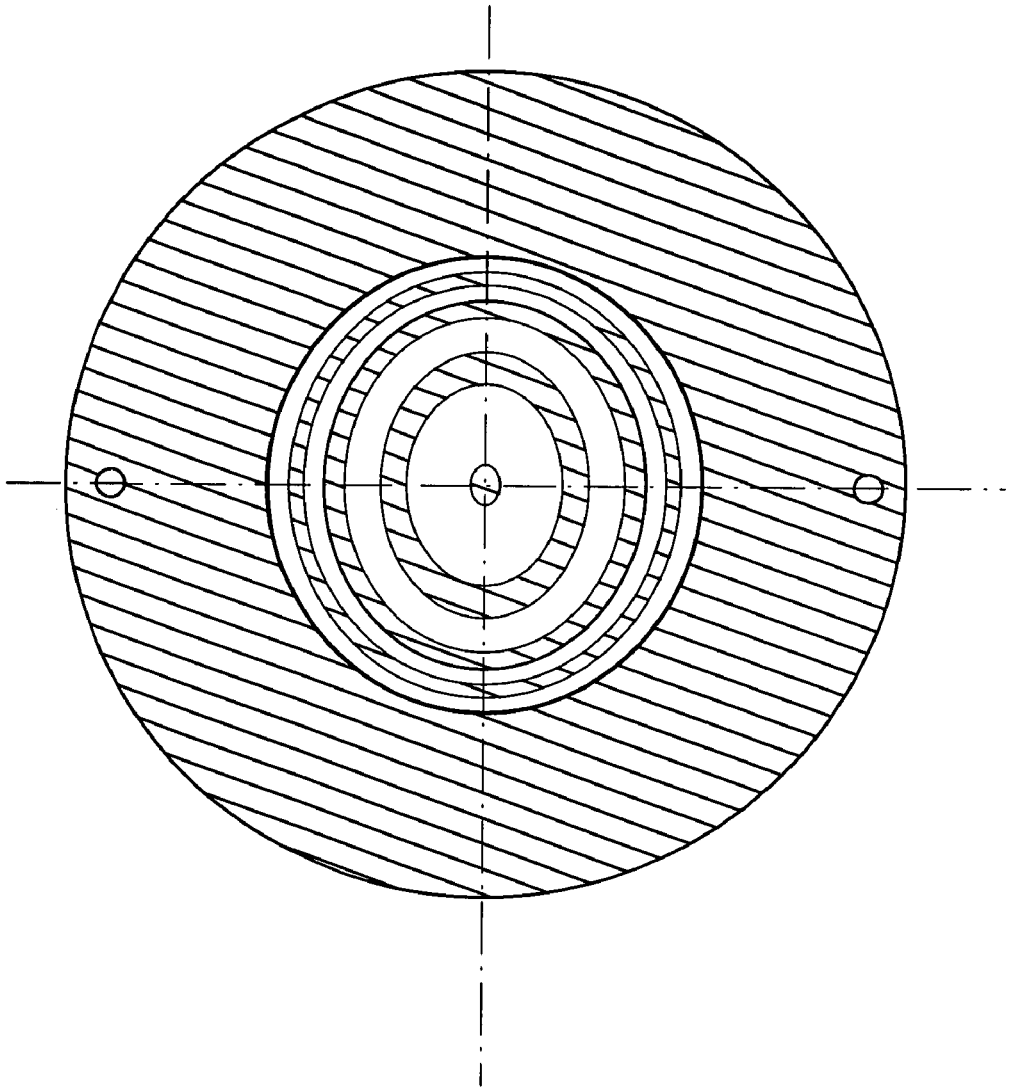
Figure 4A:
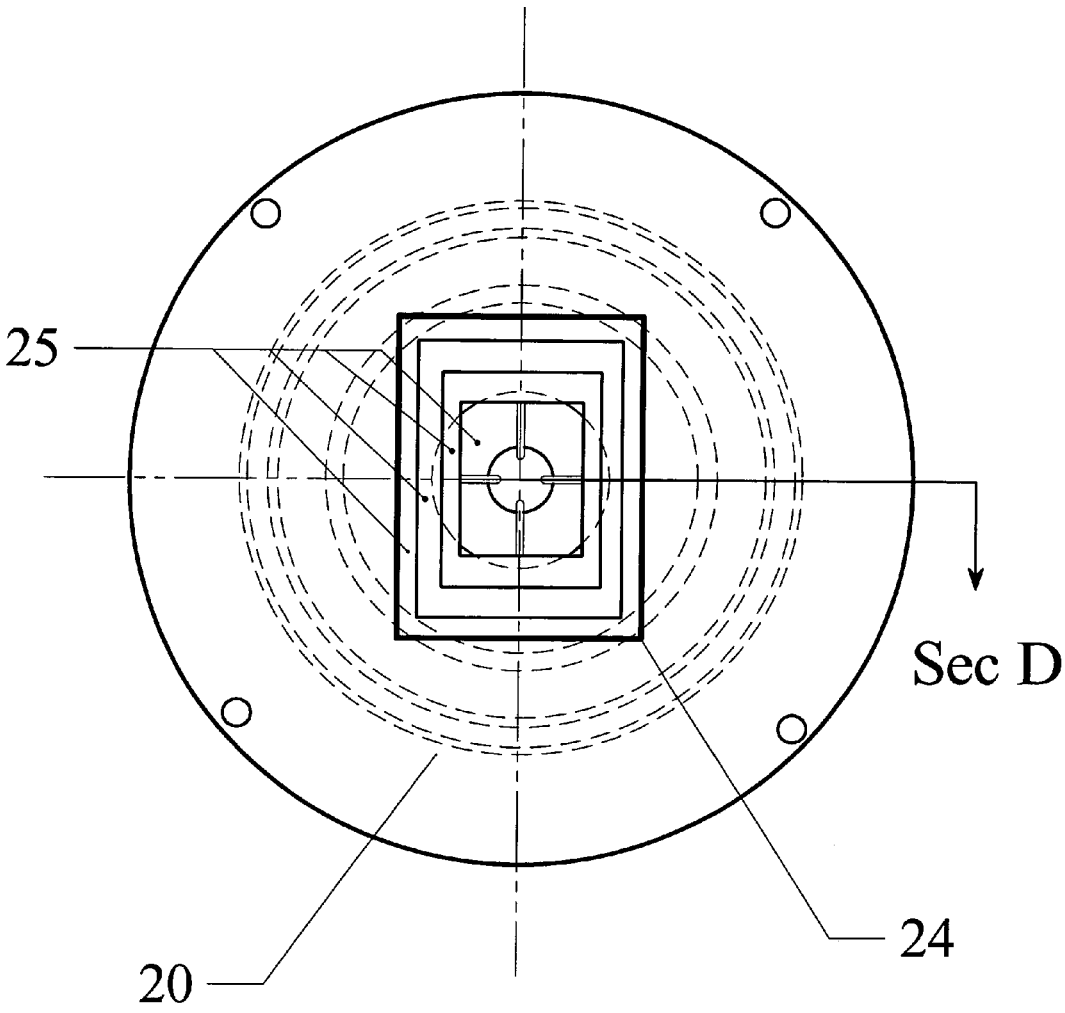
FIG. 4 shows a top view of a phase plug with a rectangular exit aperture for use on a waveguide designed around the prolate spheroidal or elliptic cylinder coordinate systems.
Figure 4B:
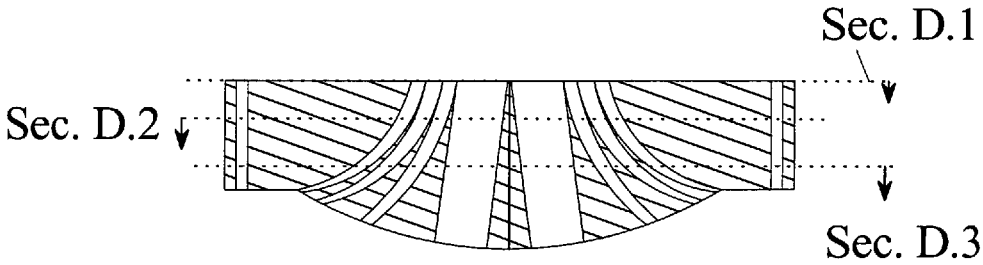
Figure 4C:
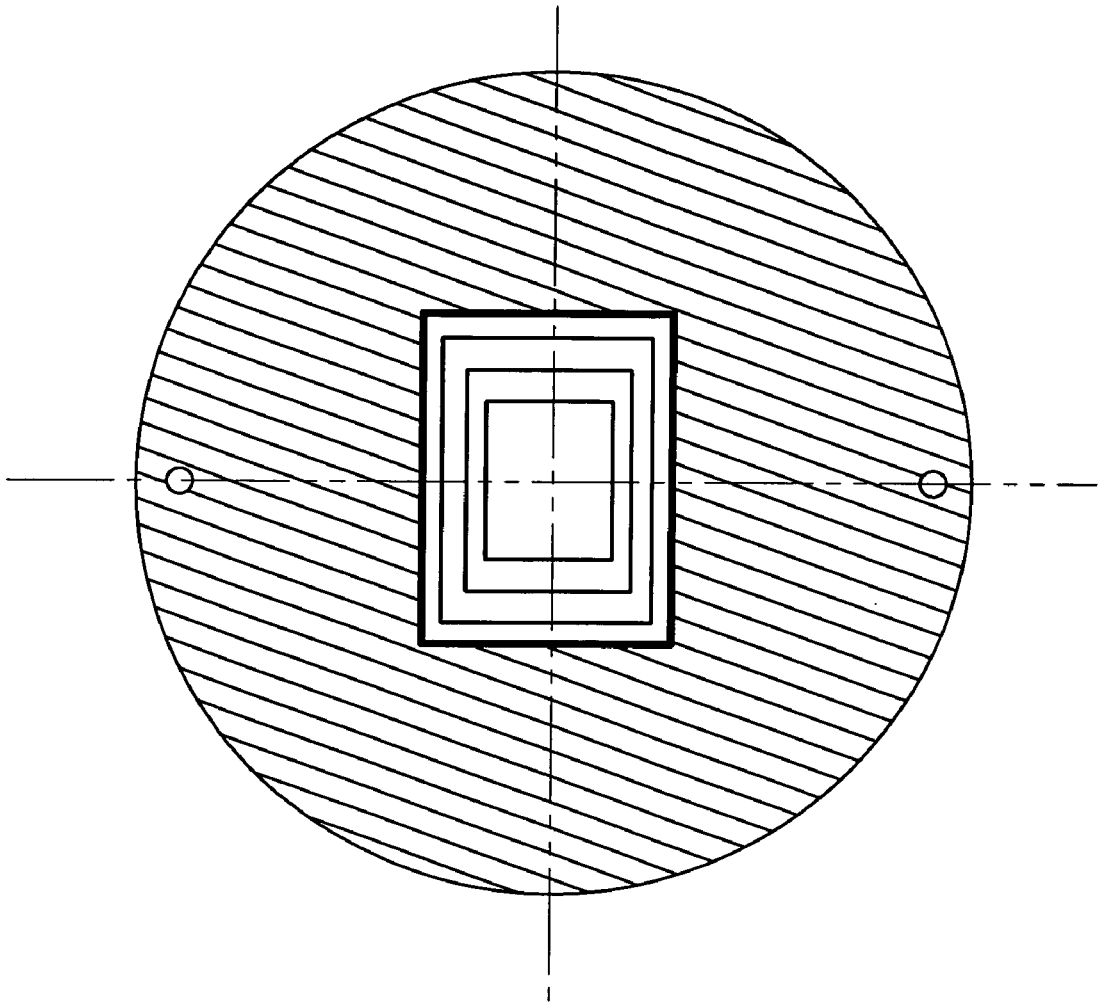
Figure 4D:
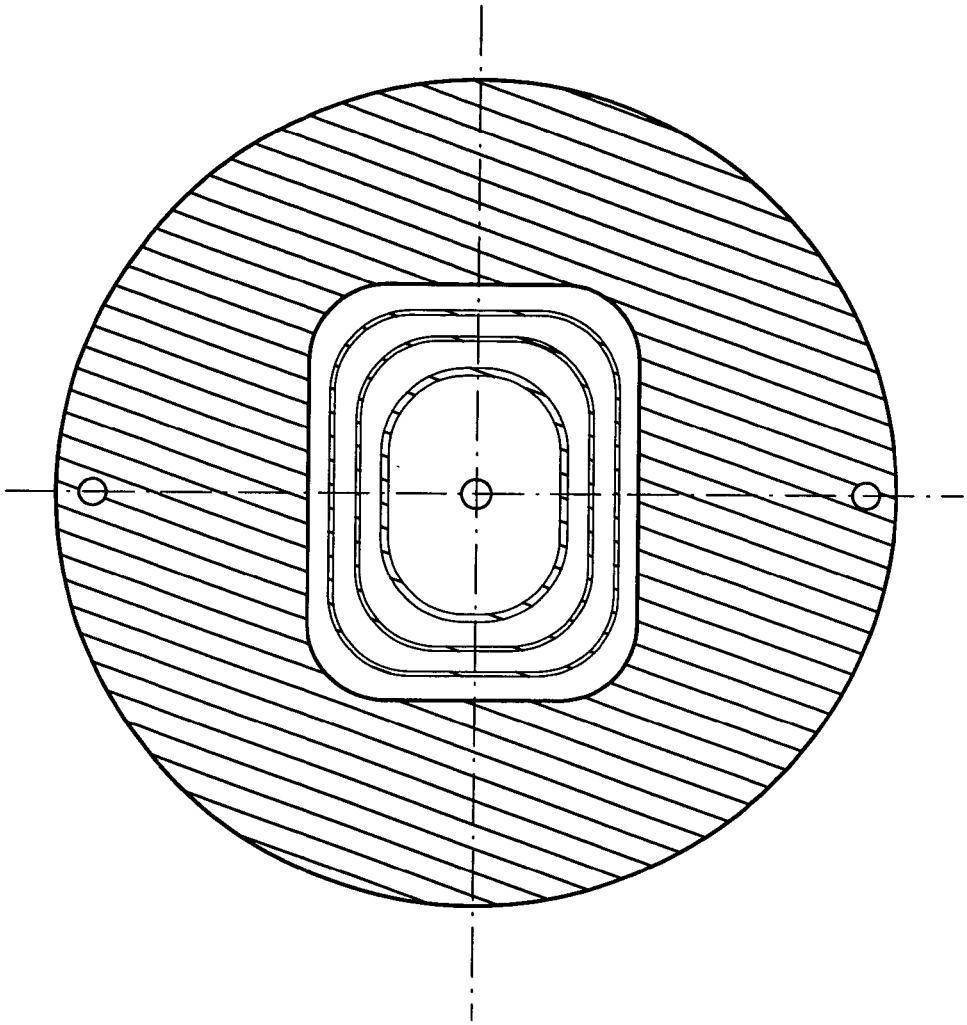
Figure 4E:
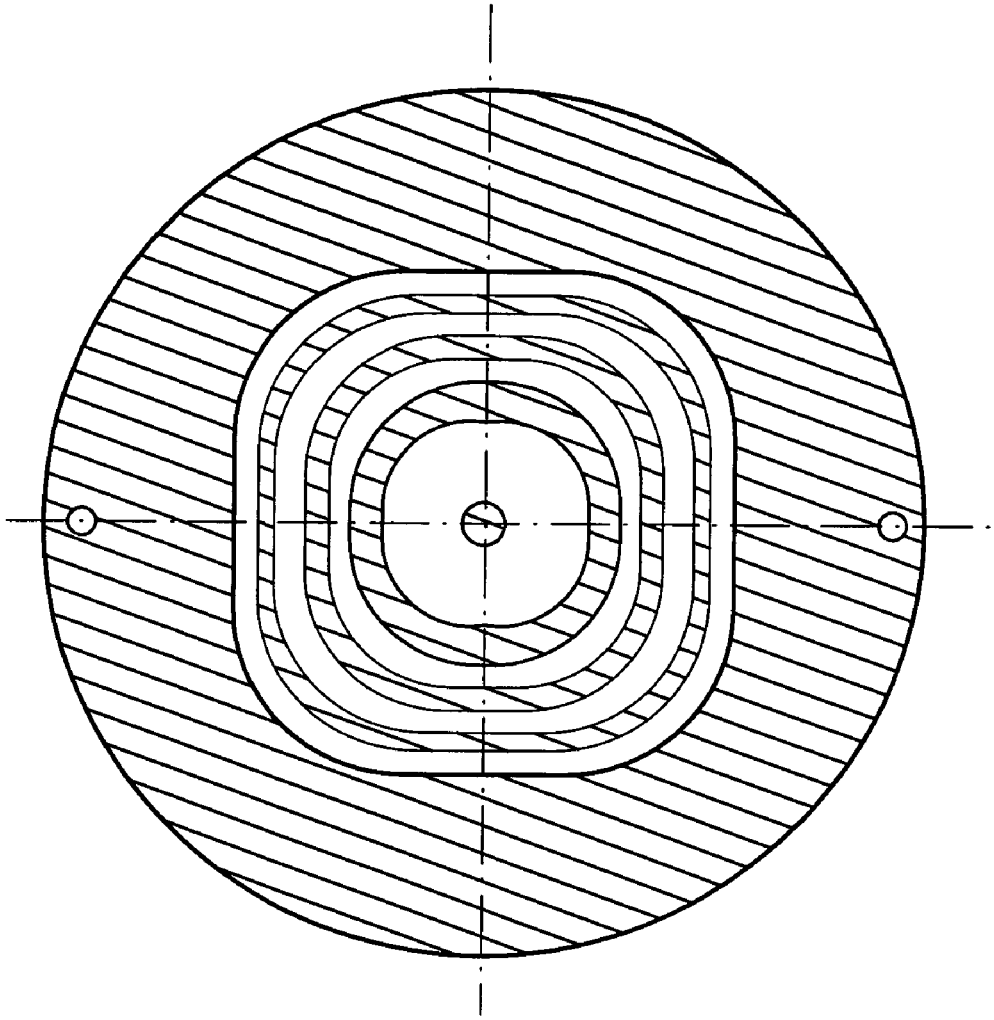

FIG. 1. shows a typical prior art implementation of a phase plug where FIG. 2 is an axi-symmetric cross section along line 0-A in FIG. 1. A means for connecting a waveguide (30) to the phase plug (20) is shown as bolts (40). The phase plug (20) is placed over the diaphragm-motor structure (not shown) by some connection means (not shown). Annular rings at the diaphragm are brought out to annular rings in the throat aperture with the intention of making the distance traveled along the various sound channels (25) approximately equal. FIG. 1 shows each channel of equal length and constant cross section, although this is merely a convenience that is not always useful or desirable. Much prior art exists for placing and sizing the phase plug sound channels (25) but this art nearly always has a basically circular throat aperture. One notable exception is that described below for FIG. 5.

FIG. 3 shows a preferred embodiment of the new phase plug design in which the phase equalizing channels of the design start out with exactly the same areas and shape as in FIG. 1, but they are morphed along their path ending in ellipses at the exit aperture. This design will optimally match a circular diaphragm to the elliptical throat of an elliptically shaped waveguide, like that created in ellipsoidal coordinates according to Geddes. Allowing the phase plug sound channels to mimic the shape of the diaphragm at the diaphragm while having the shape of these channels match the entrance (throat) of the waveguide at the phase plug's exit aperture, is the key invention of this application.

FIG. 4 shows another preferred embodiment of the new phase plug design in which the phase equalizing channels of the design start out with exactly the same areas and shape as in FIG. 1, but they are morphed along their path into nested rectangles at the exit aperture. This design will optimally match a circular diaphragm to the rectangular throat of a rectangular cross section waveguide like that required for an elliptic cylinder waveguide. The rectangular throat cross section would usually have a finite radius at the corners of the rectangles for various reasons, but t5he basic shape will be rectangular.

Figure 5A:
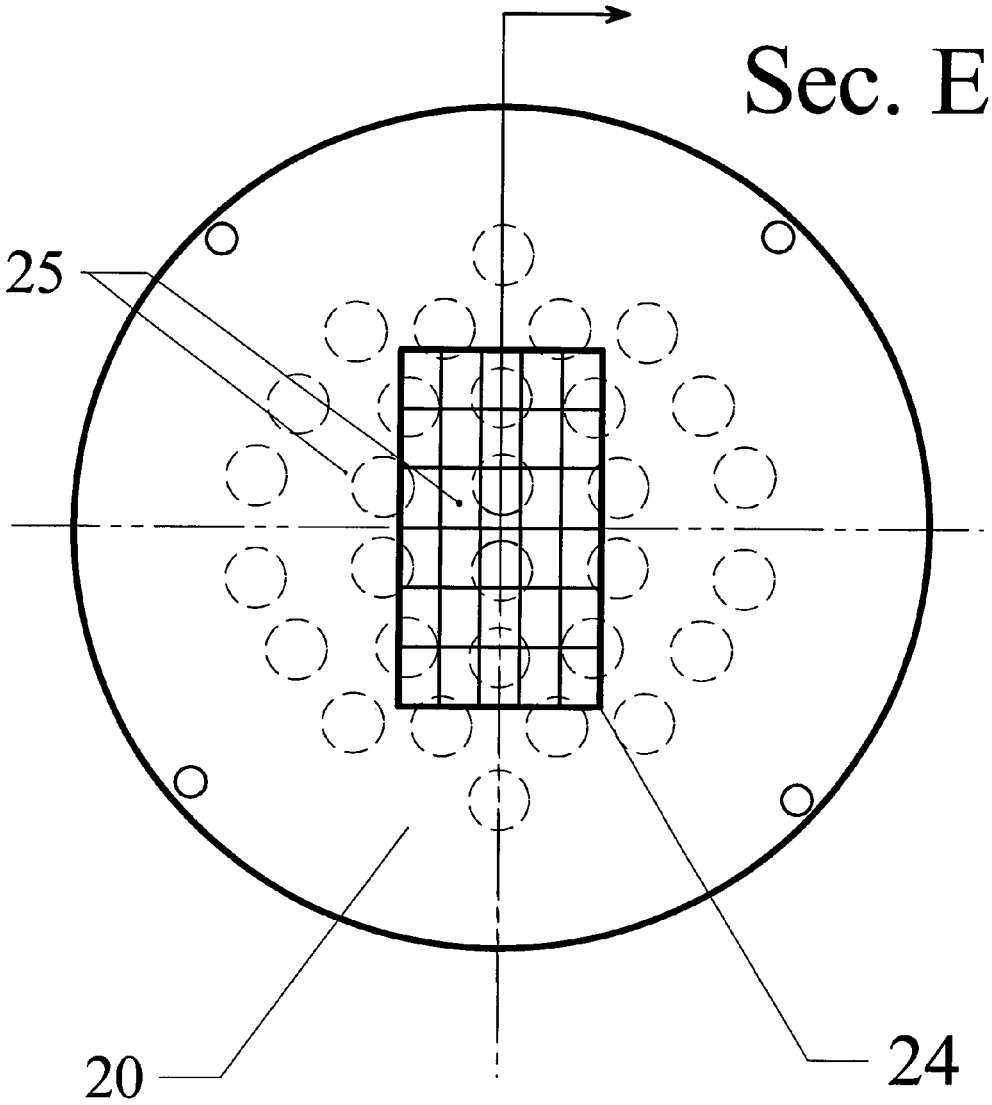
FIG. 5 shows a top view of a phase plug with a multiplicity of independent circular holes at the diaphragm and a rectangular layout of rectangular holes in the exit aperture plane.
Figure 5B:
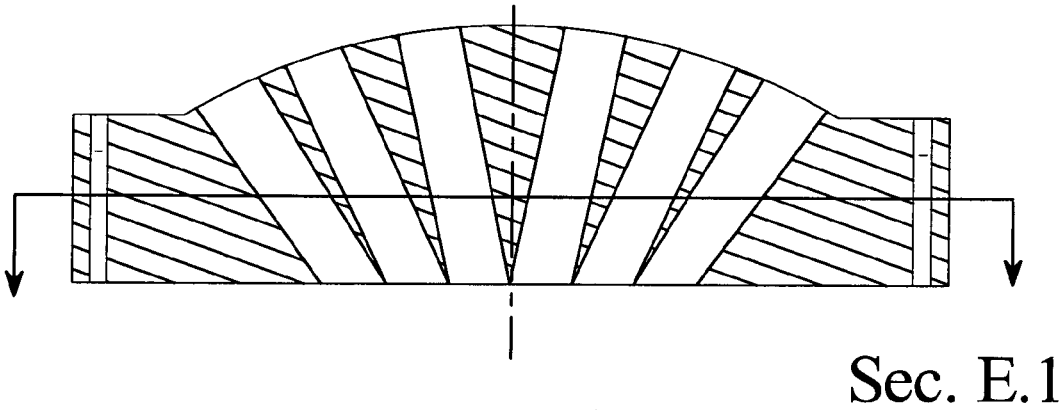
Figure 5B:
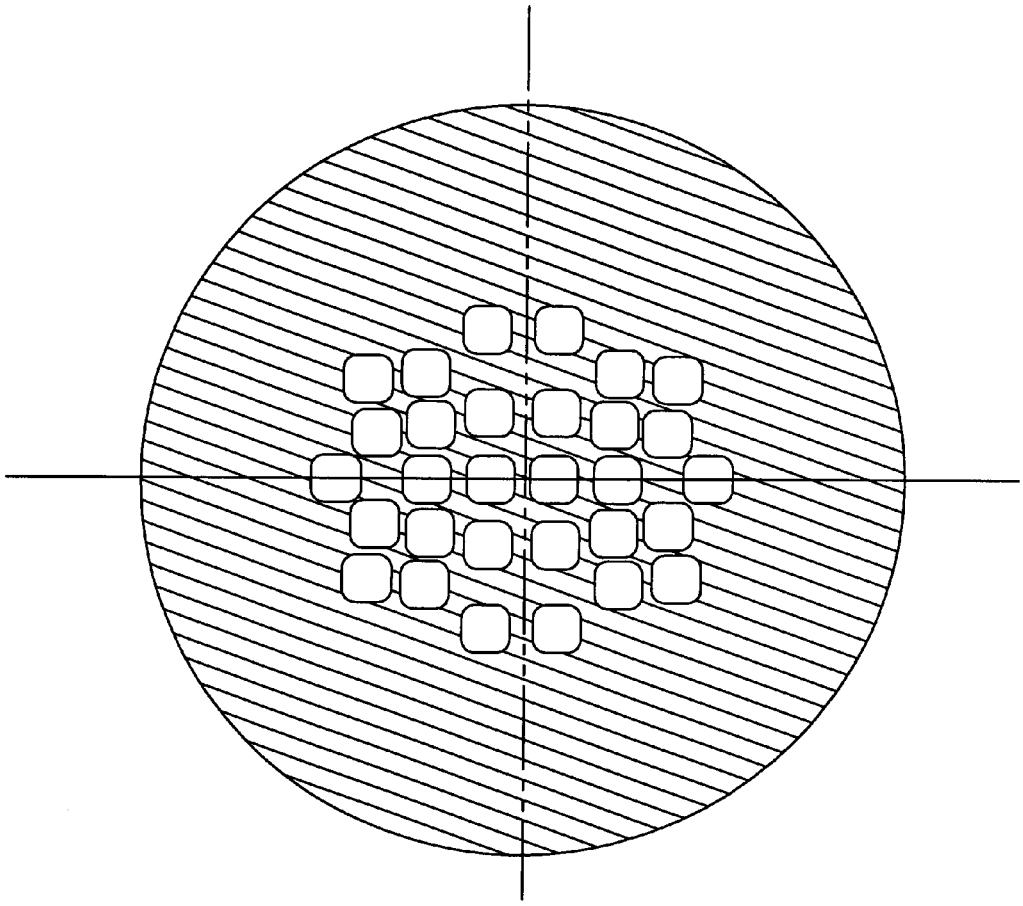

FIG. 5 shows another preferred embodiment of the new phase plug design in which the phase equalizing channels of the design start out as circular holes, but they are morphed along their path into rectangles at the exit aperture. The rectangular exit holes of the equalizing channels add up to yield the rectangular throat of an rectangular cross section waveguide. Likewise the exit exit holes of the equalizing channels could be made to add up to an elliptical aperture.

It should also be recognized that the early part of the waveguide increasing cross section may well be part of the phase plug in that the sound equalizing channels may expand in cross section as well as change shape.

One skilled in the art will recognize that there are many ways to assemble an electro-acoustic transducer composed of a drive-unit, phase plug and waveguide and that the method of assembly shown here is but one. They will also recognize that are many ways to design the phase plug equalizing channels and that the design shown here is but one example. For instance, the ratio of the diaphragm are to the area at the entrance of the phase plug (the compression ratio) could be varied, or the rate of area change along the phase equalizing channels could be varied. The invention described here relates to the change in the shape of the channels normal to the propagation direction as the channels progress from the diaphragm to the waveguide, the portion of the design usually called the phase plug.

I claim:

1. An electro-acoustic transducer for transmitting sound comprising:

a drive-unit;

a waveguide and;

a phase plug with a diaphragm end and an exit aperture, wherein:

said phase plug has sound path equalizing channels whose shapes normal to the wave propagation change from being multiple concentric annuluses at the diaphragm end, to being noncircular concentric at the exit aperture.

2. An electro-acoustic transducer as defined in claim 1 wherein:

said phase plugs sound path equalizing channels noncircular concentric shapes at the exit aperture, are ellipses.

3. An electro-acoustic transducer as defined in claim 1 wherein:

said phase plugs sound path equalizing channels noncircular concentric shapes at the exit aperture are essentially rectangular.

4. An electro-acoustic transducer as defined in claim 1 wherein:

said phase plugs sound path equalizing channels expand, along their length, corresponding to the cross sectional area expansion of the throat of a waveguide.

5. An electro-acoustic transducer as defined in claim 4 wherein:

said phase plugs sound path equalizing channels noncircular concentric shapes at the exit aperture are ellipses.

6. An electro-acoustic transducer as defined in claim 1 wherein:

said phase plugs sound path equalizing channels noncircular concentric shapes at the exit aperture are essentially rectangular.

* * * * *